US007546070B2

(12) United States Patent
Schleusener et al.

(10) Patent No.: US 7,546,070 B2
(45) Date of Patent: Jun. 9, 2009

(54) ARRANGEMENT AND METHOD FOR INKING AN APPLICATOR ELEMENT OF AN ELECTROPHOTOGRAPHIC PRINTER OR COPIER

(75) Inventors: Martin Schleusener, Namborn (DE); Uwe Höllig, München (DE)

(73) Assignee: Oce Printing Systems GmbH, Poing (DE)

( * ) Notice: Subject to any disclaimer, the term of this patent is extended or adjusted under 35 U.S.C. 154(b) by 323 days.

(21) Appl. No.: 11/658,796

(22) PCT Filed: Jul. 26, 2005

(86) PCT No.: PCT/EP2005/008122

§ 371 (c)(1),
(2), (4) Date: Jan. 24, 2007

(87) PCT Pub. No.: WO2006/010597

PCT Pub. Date: Feb. 2, 2006

(65) Prior Publication Data

US 2008/0260434 A1 Oct. 23, 2008

(30) Foreign Application Priority Data

Jul. 26, 2004 (DE) ..... 10 2004 036 159

(51) Int. Cl.
*G03G 15/09* (2006.01)

(52) U.S. Cl. ..... 399/276; 399/267; 399/272

(58) Field of Classification Search ..... 399/265, 399/266, 267, 272, 276, 277
See application file for complete search history.

(56) References Cited

U.S. PATENT DOCUMENTS

| | | | | |
|---|---|---|---|---|
| 4,067,295 | A | 1/1978 | Parker et al. | |
| 4,383,497 | A | 5/1983 | Tajima | |
| 5,926,676 | A | 7/1999 | Snelling et al. | |
| 6,049,686 | A * | 4/2000 | Folkins et al. | 399/266 |
| 6,463,244 | B2 | 10/2002 | Aoki et al. | |
| 6,571,077 | B2 | 5/2003 | Thompson et al. | |
| 6,580,891 | B1 * | 6/2003 | Meyer et al. | 399/267 |
| 2001/0038763 | A1 | 11/2001 | Aoki et al. | |

(Continued)

FOREIGN PATENT DOCUMENTS

| | | |
|---|---|---|
| EP | 0 666 517 | 8/1995 |

(Continued)

OTHER PUBLICATIONS

Patent Abstracts of Japan—Publication No. 61100775 A—May 19, 1986.

*Primary Examiner*—Hoang Ngo
(74) *Attorney, Agent, or Firm*—Schiff Hardin LLP

(57) ABSTRACT

In a method or system where inking in an electrophotographic printer or copier, a magnetic roller is provided having a rotatable magnetic roller sleeve having a circumferential surface to which a two-component mixture comprising toner particles and ferro-magnetic carrier particles adheres. An applicator element has a circumferential surface to be inked with toner particles and past which the two-component mixture adhering to the circumferential surface of the magnetic roller is guided to produce a toner layer on the applicator element. The magnetic roller has a magnetic rotor which comprises magnetic elements and arranged inside the magnetic roller sleeve. A magnetic rotor and the magnetic roller sleeve are moveable relative to one another.

19 Claims, 5 Drawing Sheets

U.S. PATENT DOCUMENTS

2005/0036806 A1 2/2005 Hollig et al.

FOREIGN PATENT DOCUMENTS

| | | |
|---|---|---|
| EP | 1 156 390 | 5/2001 |
| JP | 58-55941 | 2/1983 |
| JP | 61-180269 | 8/1986 |
| JP | 2-2384680 | 9/1990 |
| JP | 10-198175 | 7/1998 |
| WO | WO 03/036393 | 5/2003 |

* cited by examiner

ARRANGEMENT AND METHOD FOR INKING AN APPLICATOR ELEMENT OF AN ELECTROPHOTOGRAPHIC PRINTER OR COPIER

BACKGROUND

The present preferred embodiment relates to an arrangement and a method for inking an applicator element of an electrophotographic printer or copier. A two-component mixture comprising electrically charged toner particles and ferromagnetic carrier particles adheres to the outer surface of a roller. The two-component mixture adhering to the outer surface of the roller can be guided past an applicator element.

In known high-performance printers and high-performance copiers, it is common practice to produce a uniform layer of toner particles on an applicator element, in particular an applicator roller, and to use this layer to ink a charge image present on a photoconductor with toner. Further, it is known to ink the layer of toner particles present on the surface of the applicator element with the aid of a particle mixture comprising ferromagnetic carrier particles and electrically charged toner particles and adhering to the surface of a magnetic roller. This particle mixture is preferably mixed in a so-called mixing chamber, the toner particles being triboelectrically charged by this mixing process.

A paddle wheel is preferably used to bring the particle mixture into contact with the surface of the magnetic roller, which paddle wheel throws the particle mixture against the surface of the magnetic roller. Inside the magnetic roller, magnetic elements, preferably permanent magnets, are stationarily arranged which hold the ferromagnetic carrier particles and the toner particles adhering to the ferromagnetic carrier particles on the surface of the magnetic roller. At least part of the poles of magnetic elements are arranged close to the surface of the magnetic roller, as a result whereof accumulations of the two-component mixture build up in the area of these poles, which accumulations will have a brush-shaped orientation along the field lines of the magnetic field created by the respective magnetic element. These accumulations are also referred to as a magnetic brush.

Preferably, the stationary magnets are arranged inside the magnetic roller such that at least one magnetic element is arranged such that the magnetic brush created by this magnetic element contacts the surface of the applicator element, as a result whereof some of the electrically charged toner particles contained in the magnetic brush will adhere to the surface of the applicator element and are thus transferred to the applicator element. The separation of the electrically charged toner particles from the ferromagnetic carrier particles and the adhering of the toner particles to the surface of the applicator element is usually at least favored by a potential difference between the surface of the magnetic roller and the applicator element, which potential difference exerts a force on the electrically charged toner particles in the direction of the surface of the applicator element.

The layer thickness of the toner particle layer produced on the surface of the applicator element is primarily dependent on the amount of toner particles contained in the particle mixture and the potential difference between the surface of the magnetic roller and the surface of the applicator element. With the aid of the toner particle layer produced on the applicator element, a charge image present on the photoconductor is inked with toner and as a result thereof developed by way of direct contact of the applicator element with the charge image present on the photoconductor or by transferring toner particles across an air gap between the applicator element and the photoconductor. Such methods of image development are particularly known from U.S. Pat. No. 4,383,497. The layer thickness produced on the applicator element is decisive for the inking of the charge image on the photoconductor.

Given high process speeds, in particular in the case of high performance printers having printing rates of more than 150 sheets DIN A4 per minute, a stable and uniform toner charging and a uniform layer thickness of the toner particle layer produced on the applicator element is not safely guaranteed in each operating state. In the case of very high process speeds, too, in the prior art only the toner material that is present in the part of the magnetic brush contacting the applicator element is available for inking the applicator element. However, the height of the magnetic brush on the outer circumferential surface of the magnetic roller and the width of the magnetic brush in the circumferential direction, which both determine the volume of the magnetic brush, as well as the shape of the magnetic brush are particularly limited by the spatial dimensions of the developer station in which the applicator element and the magnetic roller are located.

Further, the mixing ratio of the two-component mixture cannot be changed arbitrarily in favor of the toner particle proportion since in the case of a supersaturation of the two-component mixture with toner particles the same are not sufficiently triboelectrically charged and the carrier particles will age more rapidly. For the problems described, the process speeds in known printer devices comprising an applicator element cannot be arbitrarily increased.

By providing several magnetic rollers for inking an applicator element the amount of toner particles provided for inking the applicator rollers could be increased. However in addition to increased costs, this would also result in an increased space requirement for the developer unit. Further, arrangements for inking and cleaning the applicator element are known in which two magnetic rollers are in contact with the surface of the applicator element. Such a device is known, for example, from the document WO 03/036393. The contents of this document are herewith incorporated into the present application by way of reference.

From the document U.S. Pat. No. 6,463,244 B2, an arrangement for inking an applicator element is known in which a magnetic roller is used for transporting a two-component mixture as well as for inking the applicator element. The magnetic roller has a stator comprising magnets as well as a magnetic roller sleeve rotating about this stator. Alternatively, the sleeve can be formed as a stator, and the magnetic elements are then arranged on a rotor.

From the document U.S. Pat. No. 4,067,295, an arrangement for the transport of magnetic electrically uncharged toner is known in which the magnetic properties of the toner are used for the transport.

From the document JP 58055941 A, an arrangement for the direct development of a charge image present on a photoconductor drum is known.

From the document U.S. Pat. No. 5,926,676, an arrangement for adjusting the height of a magnetic brush with the aid of oppositely arranged magnetic elements is known.

SUMMARY

It is an object to specify an arrangement and a method for inking an applicator element of an electrophotographic printer or copier, by means of which a high inking efficiency is achieved.

In a method or system where inking in an electrophotographic printer or copier, a magnetic roller is provided having a rotatable magnetic roller sleeve having a circumferential surface to which a two-component mixture comprising toner particles and ferro-magnetic carrier particles adheres. An applicator element has a circumferential surface to be inked with toner particles and past which the two-component mixture adhering to the circumferential surface of the magnetic roller is guided to produce a toner layer on the applicator element. The magnetic roller has a magnetic rotor which comprises magnetic elements and arranged inside the magnetic roller sleeve. A magnetic rotor and the magnetic roller sleeve are moveable relative to one another.

DESCRIPTION OF THE PREFERRED EMBODIMENT

Figure 1:
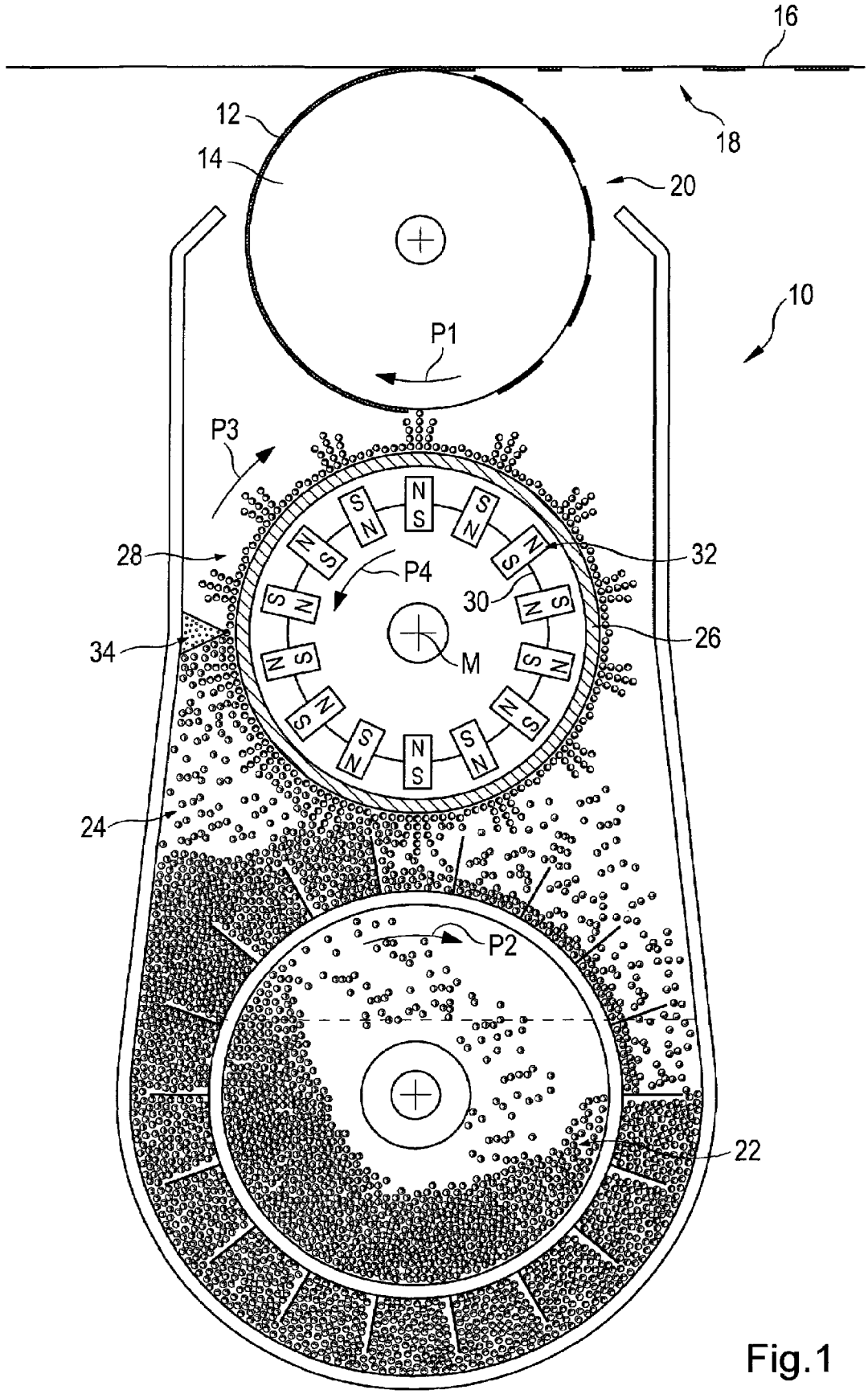
FIG. 1 illustrates a developer unit of an electrophotographic high-performance printer comprising a two-component mixture of electrically charged toner particles and ferromagnetic carrier particles.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

The arrangement of the preferred embodiment for inking an applicator element of an electrophotographic printer or copier according to claim 1 comprises a magnetic roller which is provided with a rotatable magnetic roller sleeve having a circumferential surface to which a two-component mixture comprising toner particles and ferromagnetic carrier particles adheres. Further, the arrangement comprises an applicator element having a circumferential surface to be inked, along which the two-component mixture adhering to the circumferential surface of the magnetic roller can be guided past. The magnetic roller includes a magnetic rotor comprising magnetic elements and arranged inside the magnetic roller sleeve. The rotary axis of the magnetic rotor is an axis substantially parallel to the rotary axis of the magnetic roller sleeve. The rotary axes are preferably arranged concentrically to one another.

What is achieved by way of this arrangement is that in particular by rotating the magnetic rotor a mixing of the two-component mixture on the surface of the magnet roller sleeve is effected, during which a circulation of the two-component mixture is preferably likewise effected. The toner particles are triboelectrically charged by the mixing and/or the circulation. Further, thorough mixing results in that more toner particles present in the area of the magnetic brush can be used for inking the applicator element since by means of the thorough mixing the same are also brought into an area at least close to the surface of the applicator element. Thus, for inking the applicator element not only toner particles are used that are present in an outer area of the magnetic brush but also toner particles which are originally present further down in the magnetic brush. Thus, more toner material can be transferred from the magnetic roller to the applicator element without a larger amount of the two-component mixture having to contain more toner material and without a larger amount of the two-component mixture having to be guided past the surface of the applicator element.

A second aspect of the preferred embodiment relates to a method for inking an applicator element of an electrophotographic printer or copier, in which a two-component mixture comprised of toner particles and ferromagnetic carrier particles adhering to the outer circumferential surface of a magnetic roller sleeve of a magnetic roller is guided past an applicator element's circumferential surface to be inked. When the two-component mixture is guided past, at least part of the toner particles contained in the two-component mixture are transferred to the circumferential surface of the applicator element that is to be inked. The magnetic roller comprises a magnetic rotor having several magnetic poles, the rotor being arranged inside the magnetic roller sleeve. The magnetic rotor is rotated about a rotary axis which is substantially parallel to the rotary axis of the magnetic roller sleeve.

What is achieved by this method is that the two-component mixture present on the circumferential surface of the magnetic roller sleeve is thoroughly mixed and/or circulated, the toner particles being triboelectrically charged by the thorough mixing and/or the circulation. Further, by way of thorough mixing it is achieved that a greater proportion of the toner particles contained in the two-component mixture can be used for inking the circumferential surface of the applicator element.

FIG. 1 is a schematic sectional view illustrating a developer unit 10 in which a closed toner layer 12 is produced on an applicator roller 14 in order to ink a charge image present on a photoconductor belt 16 with toner so that after inking the photoconductor belt 16 a positive toner image 18 is generated thereon and a negative toner image 20 remains on the applicator element. The applicator roller 14 is driven in the direction of the arrow P1.

A mixing drum 22 is arranged in the lower part of the developer unit 10, and is driven in the direction of the arrow P2. The mixing drum 22 is constructed similarly to a paddle wheel and mixes the mixture comprised of toner particles and ferromagnetic carrier particles present in the lower region of the developer unit 10, the so-called mixing sump. In addition, the toner particles are triboelectrically charged by a mixing motion in the mixing sump, as a result whereof they electrostatically adhere to the substantially larger carrier particles. The carrier particles with the toner particles adhering thereto are illustrated as point-shaped elements in FIG. 1. By means of the rotary motion of the mixing drum 22, part of the two-component mixture present in this area 24 is thrown against the surface of a non-magnetic sleeve 26 of a magnetic roller 28. The magnetic roller sleeve 26 is driven with the aid of a drive unit (not illustrated) in the direction of the arrow P3 about the rotary axis M.

Further, inside the non-magnetic sleeve 26 a magnetic rotor 30 is arranged which is driven in the direction of the arrow P4 and is thus rotated about the central axis M. The magnetic rotor 30 includes magnetic elements, one of which magnetic elements has the reference number 32. The magnetic elements 32 are preferably permanent magnets, the poles S, N of which are oriented radially to the surface of the non-magnetic sleeve 26, i.e. the north-south orientation of the permanent magnets extends radially. The poles N, S of adjacent magnetic elements 32 which are arranged near the inner surface of the non-magnetic sleeve 26 are different so that, of two adjacent magnetic elements 32, a north pole and a south pole are arranged close to the inner surface of the sleeve 26. In alternative embodiments, the north-south-orientation of the magnetic elements 32 can also be parallel to a tangent of the magnetic roller sleeve 26, i.e. be tangential, the two ends of each magnetic element 32 preferably having about the same distance to the magnetic roller sleeve 26.

The magnetic elements 32 which are arranged inside of the sleeve 26 in the area 24 generate magnetic fields which hold part of the carrier particles together with the toner particles adhering thereto on the surface of the sleeve 26, which carrier particles are thrown against the surface of the sleeve 26 by means of the mixing drum 22. As a result of the rotary motion of the non-magnetic sleeve 26 in the direction of the arrow P3, the two-component mixture adhering to the circumferential surface of the sleeve 26 is conveyed in the direction of the arrow P3. With the aid of a doctor blade 34, which is arranged at a distance to the circumferential surface of the sleeve 26, the layer thickness of the layer of the two-component mixture conveyed on the surface of the sleeve 26 is restricted and in doing so the amount of two-component mixture comprised of toner particles and ferromagnetic carrier particles for generating the magnetic brushes in the area of the applicator element 14 and for inking the applicator element 14 is adjusted.

On each of the magnetic elements 32, a so-called magnetic brush builds up on the non-magnetic sleeve 26, since the carrier particles of the two-component mixture are oriented by the magnetic field of the magnetic elements 32 in areas of high magnetic field strength along the field lines of the magnetic field generated by the magnetic elements 32 and are held in areas of high magnetic field strength near the poles N, S. With the aid of such a magnetic brush, the air gap between the circumferential surface of the sleeve 26 and the circumferential surface of the applicator roller 14 is bridged so that toner particles come into contact with the circumferential surface of the applicator roller 14. The rotary movement of the magnetic rotor 30 in the direction of the arrow P4 results in a conveying movement of the particle mixture in the direction of the arrow P3 on the surface of the sleeve 26 even given a standstill of the sleeve 26, as will be explained in more detail in the following in connection with FIGS. 2 to 5. When the magnetic rotor 30 is rotated in the direction of the arrow P4 and the non-magnetic sleeve 26 is rotated in the direction of the arrow P3, further the two-component mixture present on the surface of the sleeve 26 is thoroughly mixed and circulated.

Figure 2:
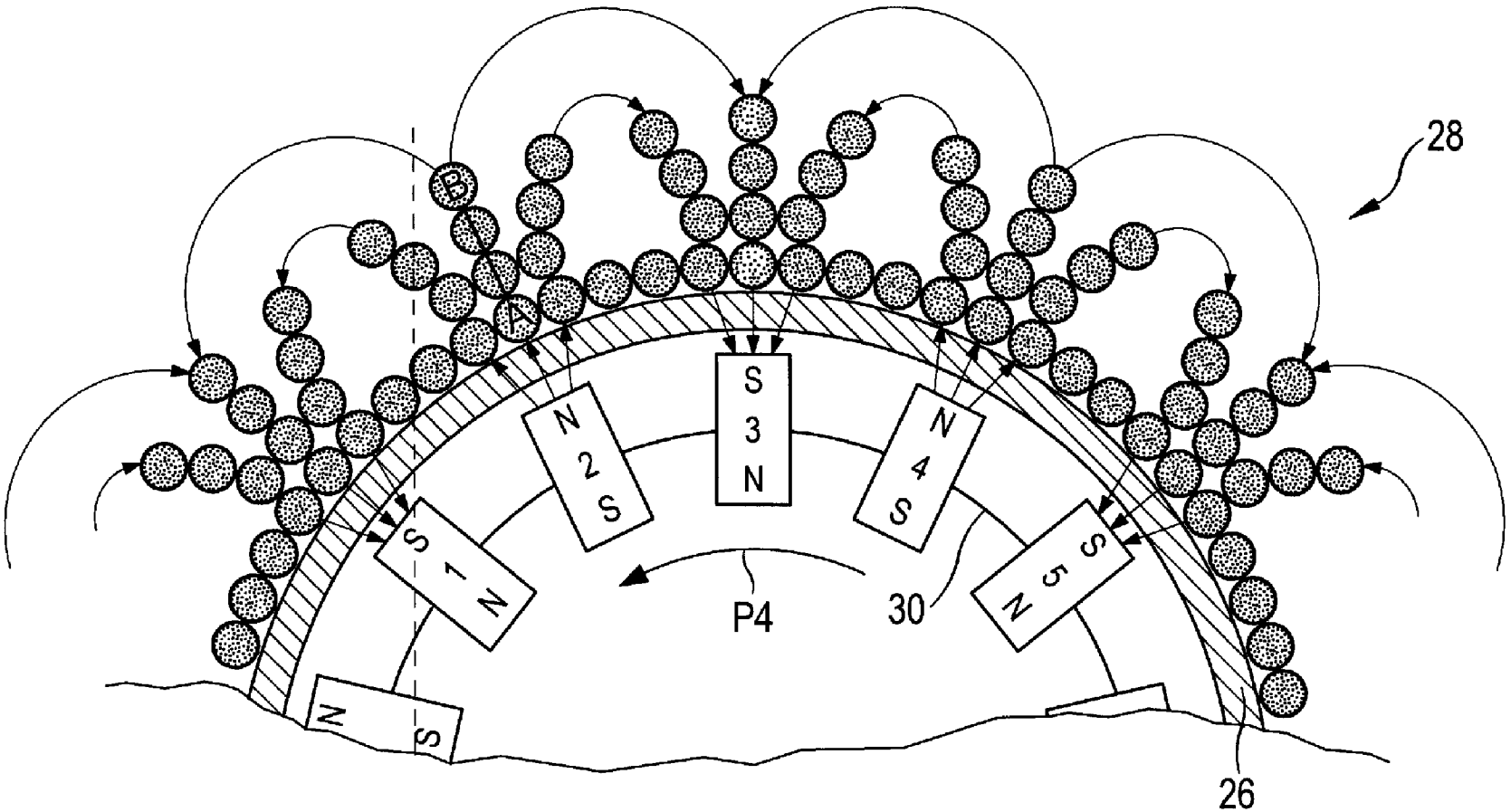
FIGS. 2 to 5 are sectional views of a magnetic roller in to FIG. 1 in a temporal sequence of four successive positions of a magnetic rotor of the magnetic roller for illustrating a mixing process of the two-component mixture present on the surface of the magnetic roller.

In FIG. 2, a detail of the magnetic roller 28 according to FIG. 1 is illustrated, a two-component mixture comprised of electrically charged toner particles and ferromagnetic carrier particles being present on the surface of the non-magnetic sleeve 26. Elements having the same function and/or constitution have identical reference numbers. As already explained in connection with FIG. 1, the relatively small toner particles adhere to the relatively large carrier particles. For illustrating the mixing process, the movement of two exemplarily chosen carrier particles A and B on the surface of the sleeve 26 is illustrated in the following in a temporal sequence in FIGS. 2 to 5, each of the FIGS. 2 to 5 illustrating a state of the magnetic roller and of the particle mixture at a different point in time. The carrier particles shown in FIGS. 1 to 5 are drawn to a very large scale, in particular in the illustrations of the FIGS. 2 to 5, the carrier particles being illustrated as an area that is filled with small dots and the toner particles adhering to the carrier particles as a black ring around this filled area. Thus, the illustrated carrier particles with the toner particles adhering thereto are likewise illustrated in a sectional view. For simplification of the illustration of the sequence of motions of the magnetic rotor 30, the magnetic elements relevant for explanation purposes are referenced 1 to 7 in FIGS. 2 to 5.

In FIG. 2, the carrier particles A, B are shown in the middle of the magnetic brush generated by the magnetic element 2 at a first point in time, the carrier particles A, B being spaced to one another in the radial direction. The carrier particle A is arranged on the circumferential surface of the sleeve 26 and the carrier particle B is arranged at the tip of the middle bristle of the magnetic brush generated by the magnetic element 2 on the outer circumferential surface. The ferromagnetic carrier particles orient themselves along the field lines in an area on the circumferential surface of the magnetic roller sleeve with a high magnetic field strength and thus build up to form magnetic brushes. In FIG. 2, several field lines of the magnetic fields generated between the poles of the magnetic elements are exemplarily illustrated.

Figure 3:
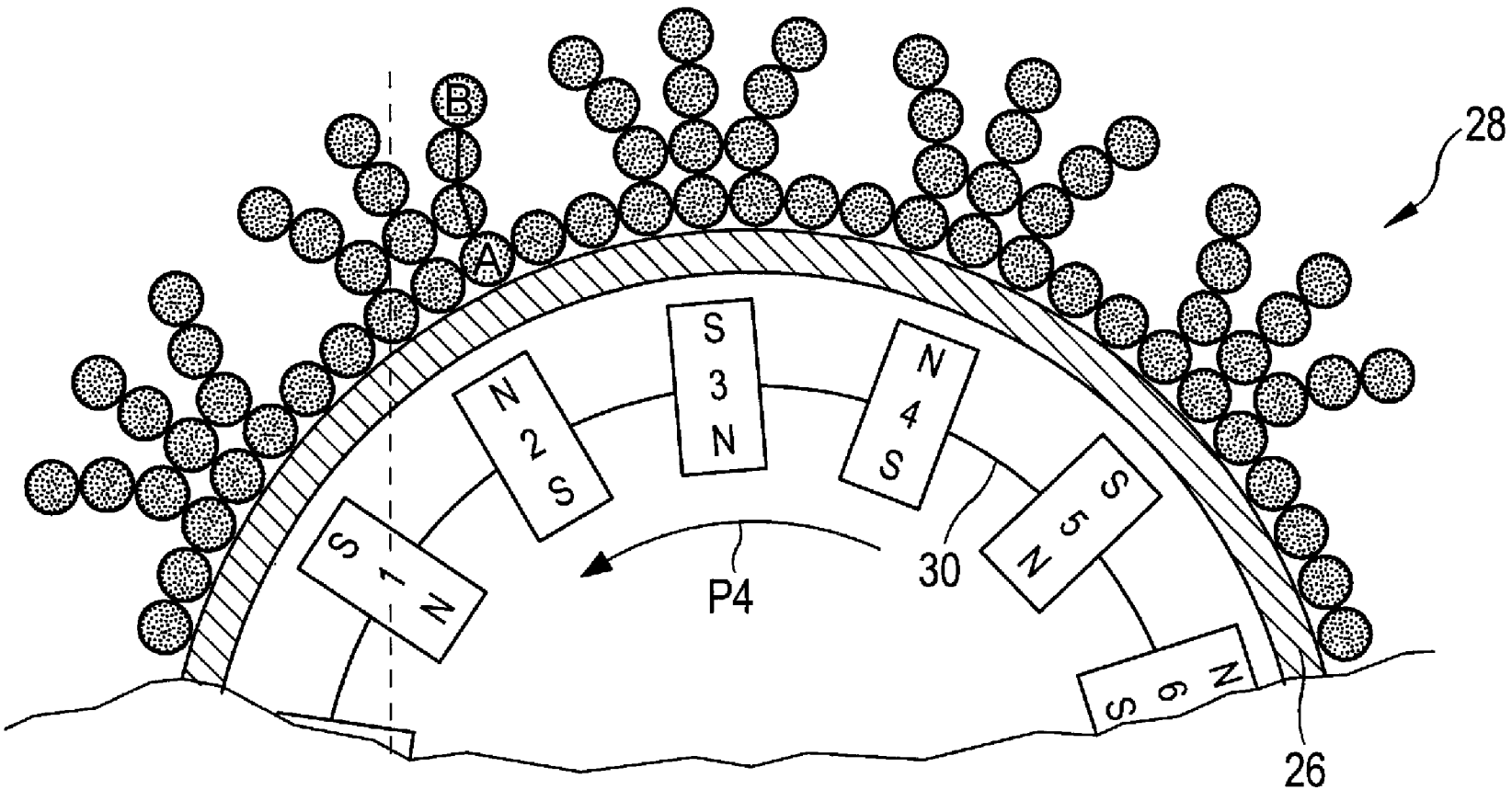

In FIG. 3, the sectional view of the magnetic roller 28 according to FIG. 2 is illustrated at a second later point in time. In contrast to FIG. 2, the magnetic rotor 30 has been rotated a little further in the direction of the arrow P4, the non-magnetic sleeve 26, as already mentioned, being stationary in FIGS. 3 to 6 for explanation of the mixing process. Here too, each of the magnetic elements 1 to 5 generates a magnetic brush on the outer circumferential surface of the sleeve 26. The carrier particles A and B, however, in contrast to the illustration according to FIG. 2, are located along the right-hand edge of the magnetic brush generated by the magnetic element 2. The carrier particle B is located at the tip of the right-hand bristle and the carrier particle A is still at the bottom of the bristle directly on the circumferential surface of the sleeve 26.

Figure 4:
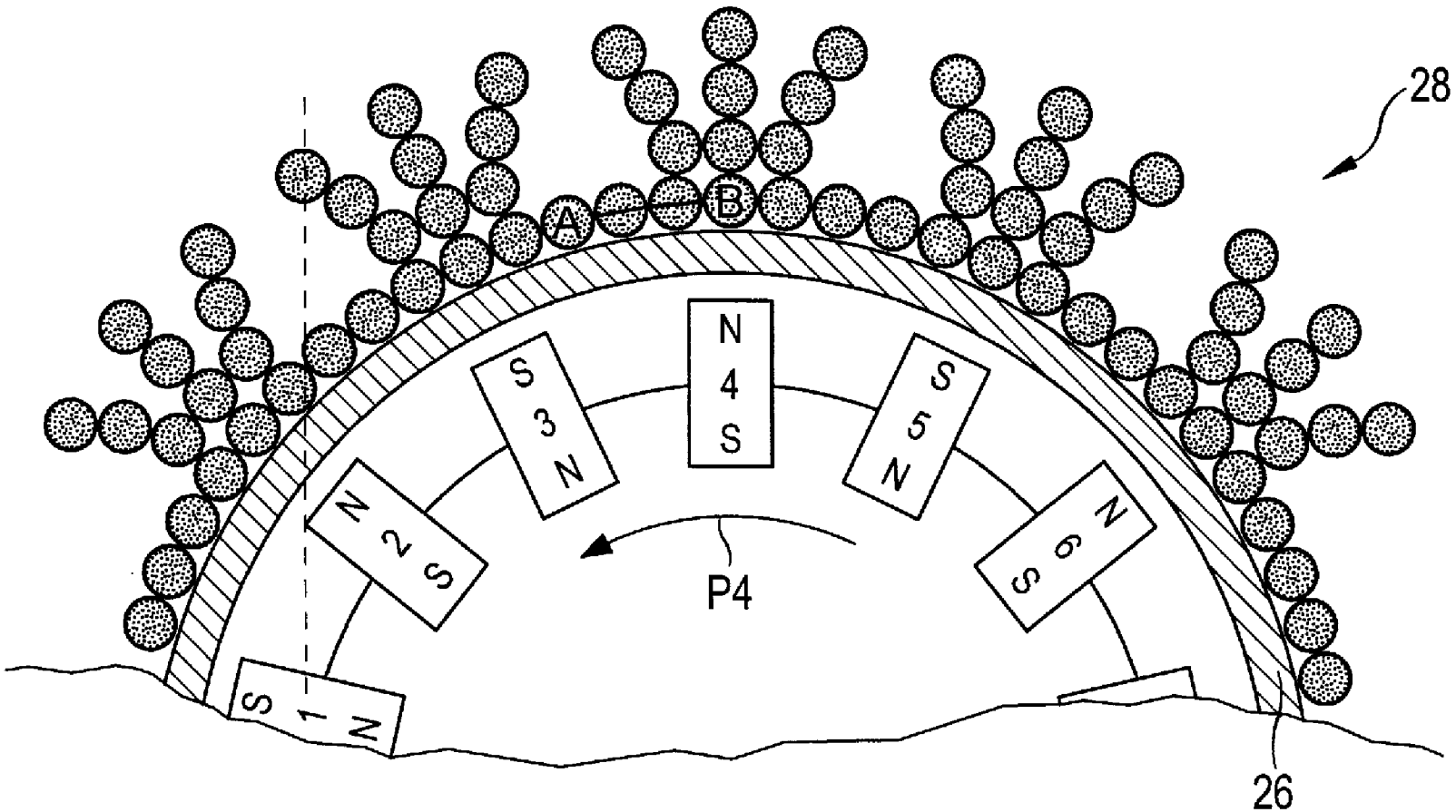

In FIG. 4, the illustration of the magnetic roller 28 according to FIGS. 2 and 3 is shown at a third point in time. The magnetic rotor 30 has been rotated further in the direction of the arrow P4, as a result whereof the carrier particle B has moved in particular by way of the magnetic fields generated by the magnetic elements 3 and 4 from the tip of the magnetic brush at the magnetic element 2 according to FIGS. 2 and 3 to the surface, i.e. to the outer circumferential surface of the sleeve 26 so that in the arrangement according to FIG. 4, both carrier particles A, B are located on the circumferential surface of the sleeve 26.

Figure 5:
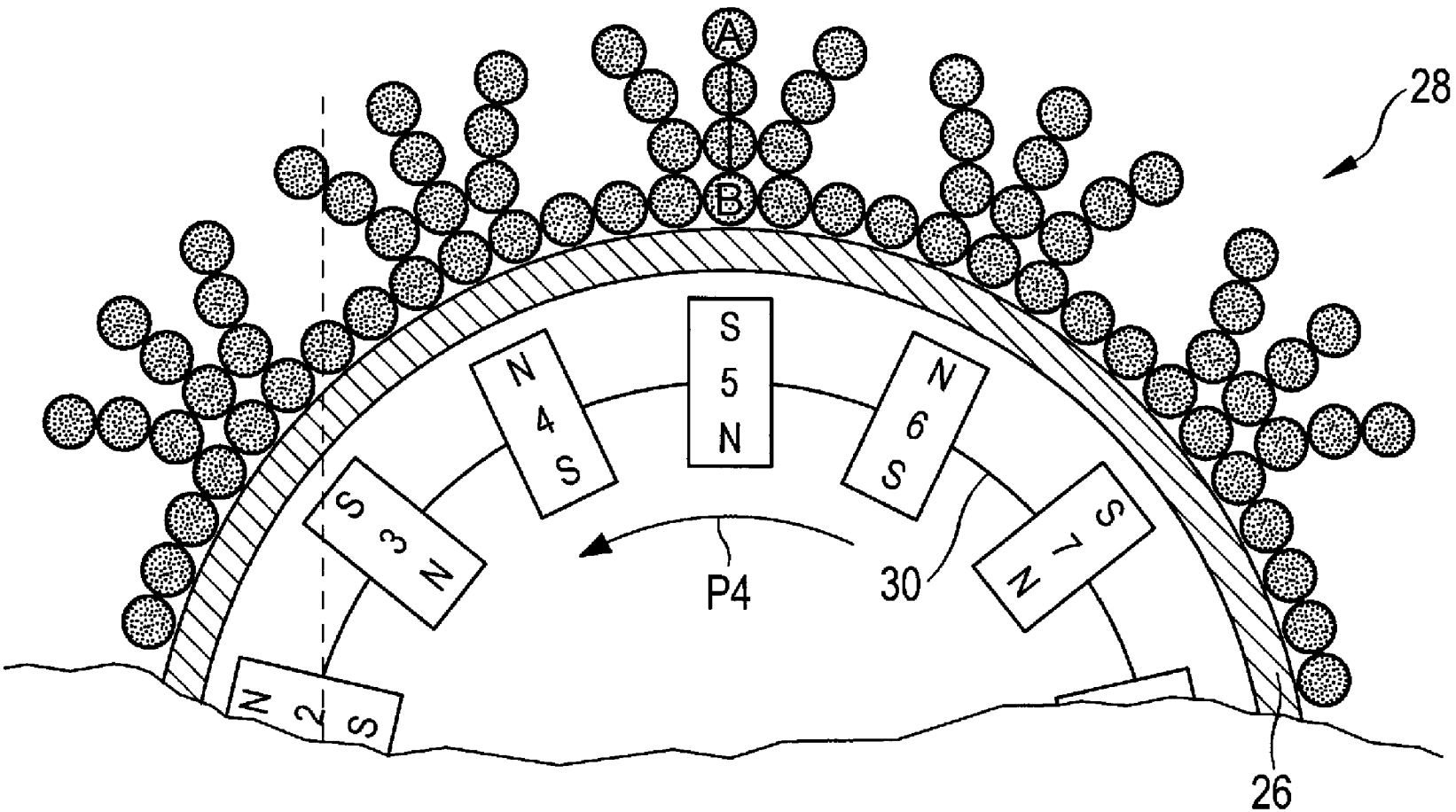

In FIG. 5, a further sectional view of the magnetic roller 28 according to FIGS. 2 to 4 is illustrated at a further point in time, the magnetic rotor 30 having been rotated further in the direction of the arrow P4. As a result of the further rotation of the magnetic rotor 30 in the direction of the arrow P4, a magnetic brush is formed in the area of the magnetic element 5 on the circumferential surface of the sleeve 26, in which brush the carrier particle B, as already shown in FIG. 4, is arranged or has remained on the surface of the sleeve 26 and the carrier particle A has reached upwards to the tip of the middle bristle of the magnetic brush by means of the magnetic field generated by the magnetic element 5 as a result of the orientation of the carrier particles along the magnetic field lines.

As exemplarily shown in FIGS. 2 to 5, by way of circulation of the carrier particles A, B the entire two-component mixture is thoroughly mixed, as a result of which the electrically charged toner particles are further triboelectrically charged and thus electrostatically adhere to the carrier particles present on the sleeve. Further, the toner particles thus reach the area of the bristle tips so that these toner particles adhering to these carrier particles can likewise be used for inking the applicator roller 14.

As can be seen, however, with reference to FIGS. 2 to 5, given a rotation of the magnetic rotor 30 in the direction of the arrow P4, the particle mixture present on the outer circumferential surface of the sleeve 26 is also conveyed further in the circumferential direction by about 25° in an opposite direction to the arrow P4 on the circumferential surface of the sleeve 26 from the first point in time illustrated in FIG. 2 to the fourth point in time illustrated in FIG. 5. If the sleeve 26 is additionally rotated opposite to the direction of the arrow P4, then the mixing process is further increased and more toner material is guided past the applicator roller 14, as a result of which, even in the case of very high process speeds of >1 m/s sufficient toner material for generating the closed toner layer with a constant preset layer thickness on the surface of the applicator roller 14 is available.

The magnetic elements 32, shown as 1 to 7, of the magnetic rotor 30 substantially extend over the entire length of the circumferential surface in an axial direction of the sleeve 26 and preferably each have the same distance to the sleeve 26 and generate approximately the same magnetic field strength on the circumferential surface of the sleeve. Further, the magnetic elements are uniformly distributed over the circumference of the rotor 30, preferably having the same distance to one another. Further, an even number of magnetic elements 1 to 7 is preferably provided. Moreover, it is advantageous when adjacent poles (N, S) arranged near the inner surface of the sleeve 26 have a different polarity (N, S). The magnetic elements are preferably arranged such that north and south areas of strong magnetic fields on the circumferential surface of the sleeve 26 alternate.

In other embodiments of the preferred embodiment, two adjacent magnetic elements 1, 2 can also be oriented identically so that the poles of these adjacent magnetic elements 1, 2 which are arranged close to the sleeve 26 are identical poles. Further, in other embodiments the cylindrical sleeve can also have an oval section or the section of a polygon. The cylindrical sleeve preferably contains a non-magnetic substance, in particular the surface of the sleeve including aluminum, chromium, nickel, copper, an electrically conductive plastic material and/or a plastic material having an electrically conductive layer. The roughness of the surface of the sleeve is preferably in the range between 1 and 5000 μm. The sleeve 26 and the magnetic rotor 30 are driven with separate drive units. Alternatively, the sleeve and the magnetic rotor 30 can be driven with the aid of a drive unit having at least one interposed gear. Either the sleeve 26 or the magnetic rotor 30 is driven directly by the drive unit and the respective other element is driven via the interposed gear reversing the direction of rotation.

What is essential for the preferred embodiment is that both the magnetic rotor 30 as well as the magnetic roller sleeve 26 are rotatable and are preferably moved relative to one another. This relative movement can be achieved either by different drive speeds which result in different revolutions per minute of the magnetic roller sleeve 26 and of the magnetic rotor 30 or by an opposite direction of rotation of the magnetic roller sleeve 26 and the magnetic rotor 30. Further, several magnetic elements are arranged at the rotor 30 or integrated in the rotor 30 which are distributed uniformly over the circumference of the rotor 30 and which substantially generate an identical magnetic field strength as well as have identical dimensions. Further, the magnetic elements 32, shown as 1 to 7, have the same distance to the rotary axis M of the magnetic rotor 30. At least a first magnetic pole N, S of each magnetic element 32, shown as 1 to 7, is arranged close to the inner surface of the magnetic roller sleeve 26. By the magnetic field between this first magnetic pole N, S and at least a further magnetic pole S, N of a further magnetic element 32, shown as 1 to 7, and/or with the magnetic poles N, S of further magnetic elements 32, shown as 1 to 7, a magnetic field having a high magnetic field strength is generated at least in an area on the outer circumferential surface of the magnetic roller sleeve 26 near the first magnetic pole N, S. This area of high magnetic field strength exerts a force on the ferromagnetic carrier particles which are present in this area and orient themselves along the field lines in this area. As a result thereof, the ferromagnetic carrier particles on the circumferential surface of the magnetic roller 26 build up to form individual bristles which altogether form a brush, as a result whereof a brush formed in this way is also referred to as a magnetic brush. As already explained, toner particles adhere to the ferromagnetic carrier particles oriented along the field lines, so that the toner particles adhering to the side of the magnetic brush facing the applicator element 14 contact the circumferential surface of the applicator element 14. At least in some part of the area with high magnetic field strength, the field lines perpendicularly exit the circumferential surface of the magnetic roller sleeve 26 or perpendicularly enter the circumferential surface of the magnetic roller sleeve 26. As already mentioned, it is advantageous to have the north-south-orientation of the magnetic elements 32, shown as 1 to 7U, at the magnetic rotor 30 extend radially each time, as a result whereof one magnetic pole of each magnetic element 32, shown as 1 to 7, is oriented in radial direction towards the sleeve 26. The magnetic elements 32, shown as 1 to 7, whose north-south-orientation is radially oriented, have on the circular path formed by their ends directed towards the inner side of the magnetic roller sleeve 26 a distance between adjacent edges in the range of 0.01 to 10 mm in circumferential direction.

If both the magnetic rotor 30 as well as the magnetic roller sleeve 26 are driven in the same direction of rotation, the rotary speeds with which the magnetic rotor 30 and the magnetic roller sleeve 26 are driven are so different that the carrier particles and the toner particles adhering thereto which form themselves as a layer and as brushes on the circumferential surface of the magnetic roller sleeve 26 are thoroughly mixed given rotary motions of the magnetic rotor 30 and the magnetic roller sleeve 26 so that even toner particles and carrier particles directly contacting the circumferential surface of the magnetic roller sleeve 26 reach the tips of the magnetic brushes.

In the developer unit 10 illustrated in FIG. 1, the direction of rotation of the mixing drum 22 is opposite to the direction of rotation of the magnetic roller sleeve 26. The direction of rotation P1 of the applicator roller 14 is likewise opposite to the direction of rotation P3 of the sleeve 26. In other embodiments, the directions of rotation P2 and P3 of the mixing drum 22 and of the sleeve 26 and/or the directions of rotation P3, P1 of the sleeve 26 and of the applicator roller 14 can be the same. In FIG. 1, the direction of rotation P1 corresponds to the running direction of the photoconductor belt 16. In alternative embodiments, the direction of rotation of the applicator roller 14 can also be opposite to the running direction of the photoconductor belt 16, as a result whereof more toner material is available for inking the charge image on the photoconductor belt 16. The direction of rotation P4 of the magnetic rotor 30 is opposite to the direction of rotation P3 of the sleeve 26 of the magnetic roller 28. In alternative embodiments, the directions of rotation P3 and P4 of the magnetic rotor 30 and of the sleeve 26 can also be the same, the drive speeds of the magnetic rotor 30 and of the sleeve 26 then preferably being different. Alternatively, the magnetic rotor 30 and the sleeve 26 can also have different rotary axes M. The direction of rotation of the magnetic rotor 30, of the magnetic roller sleeve 26 and of the applicator element 14 as well as their revolutions per minute and their drive speeds are chosen in the preferred embodiment such that the magnetic brushes generated on the circumferential surface of the magnetic roller sleeve 26 are guided past the applicator element's circumferential surface to be inked with such a frequency that a uniform toner particle layer having a constant thickness or height is generated on the circumferential surface of the applicator element 14.

Although in the drawings and in the preceding description preferred embodiment has been illustrated and described in every detail, this is to be considered as being merely exemplary and as not restricting the invention. It is pointed out that only the preferred embodiment has been illustrated and described and that all changes and modifications that come within the spirit of the invention both now or in the future are desired to be protected.

We claim:

1. An arrangement for inking in an electrophotographic printer or copier, comprising:

a magnetic roller having a rotatable magnetic roller sleeve having a circumferential surface to which a two-component mixture comprising toner particles and ferromagnetic carrier particles adheres;

an applicator element having a circumferential surface to be inked with toner particles and past which the two-component mixture adhering to the circumferential surface of the magnetic roller is guided to produce a toner layer on the circumferential surface of the applicator element;

the magnetic roller having a magnetic rotor which comprises magnetic elements and which is arranged inside said magnetic roller sleeve;

the magnetic elements being substantially uniformly distributed over a circumference of the magnetic rotor;

a rotary axis of the magnetic rotor being an axis parallel to a rotary axis of the magnetic roller sleeve; and at least one drive unit which drives both the magnetic rotor and the magnetic roller sleeve and which moves the magnetic rotor and the magnetic roller sleeve relative to one another.

2. An arrangement according to claim 1 wherein at least a first magnetic pole of each magnetic element is arranged close to an inner surface of the magnetic roller sleeve, wherein as a result of a magnetic field between the first magnetic pole and at least a further magnetic pole at least in an area on an outer circumferential surface of the magnetic roller sleeve near the first magnetic pole a magnetic field having a high magnetic field strength for generating a magnetic brush of two-component mixture on the circumferential surface is provided.

3. An arrangement according to claim 2 wherein at least part of field lines in an area of high magnetic field strength on the circumferential surface perpendicularly exit the circumferential surface of the magnetic roller sleeve and/or perpendicularly enter the circumferential surface.

4. An arrangement according to claim 1 wherein each magnetic element substantially extends over an entire axial length of the magnetic roller sleeve, the magnetic poles of the magnetic elements each having substantially a same distance to the circumferential surface of the sleeve over substantially the entire length.

5. An arrangement according to claim 1 wherein a north-south orientation of each magnetic element at the magnetic rotor extends radially.

6. An arrangement according to claim 1 wherein a north-south orientation of the magnetic elements is arranged tangentially to the magnetic roller sleeve.

7. An arrangement according to claim 1 wherein each magnetic element generates a substantially identical magnetic field strength and/or in that the magnetic elements are uniformly distributed over the circumference of the magnetic rotor.

8. An arrangement according to claim 1 wherein the magnetic elements are distributed on a circular path on the magnetic roller rotor, said path being concentric to the magnetic roller sleeve.

9. An arrangement according to claim 1 wherein an even number of the magnetic elements is provided, the magnetic elements being arranged in a uniformly distributed manner over the circumference of the magnetic rotor.

10. An arrangement according to claim 1 wherein the magnetic rotor and the magnetic roller sleeve are driven in a same direction of rotation, are driven at different speeds, or are driven in opposite directions of rotation.

11. An arrangement according to claim 1 wherein a direction of rotation of the magnetic roller sleeve is the same or an opposite direction of rotation as a direction of rotation of the applicator element.

12. An arrangement according to claim 1 wherein the cylindrical magnetic roller sleeve includes a non-magnetic substance, and at least in an area of an axial extension of the magnetic poles a material thickness of the magnetic roller sleeve is substantially constant over the circumference.

13. An arrangement according to claim 1 wherein the circumferential surface of the magnetic roller sleeve comprises aluminum, chromium, nickel, copper, electrically conductive plastic material and/or a plastic material having an electrically conductive layer.

14. An arrangement according to claim 1 wherein the magnetic elements each comprise at least one permanent magnet.

15. An arrangement according to claim 1 wherein a doctor blade is arranged at a distance to the surface of the sleeve and adjusts an amount of the two-component mixture comprised of the toner particles and the ferromagnetic carrier particles for generating magnetic brushes in an area of the applicator element and for the inking of the applicator element.

16. A method for inking in an electrophotographic printer or copier, comprising the steps of:

guiding a two-component mixture comprising electrically charged toner particles and ferromagnetic carrier particles adhering to a circumferential surface of a magnetic roller sleeve of a magnetic roller past a circumferential surface of the applicator element to be inked, the magnetic roller comprising a magnetic rotor having several magnetic poles and being arranged inside the magnetic roller sleeve, the magnetic elements being uniformly distributed over a circumference of the magnetic rotor, both the magnetic rotor as well as the magnetic roller sleeve each being rotated about their respective longitudinal axis, and the magnetic rotor and the magnetic roller sleeve each being driven and in doing so moved relative to one another; and when the two-component mixture is guided past, transferring at least part of the toner particles contained in the two-component mixture onto the circumferential surface of the applicator element to be inked so that a toner layer is produced on the circumferential surface of the applicator element.

17. A method according to claim 16 wherein the magnetic rotor and the magnetic roller sleeve are driven in different directions of rotation or in a same direction of rotation and at different rotational speeds, as a result whereof a relative movement is each time produced between the magnetic rotor an the magnetic roller sleeve by means of which the two-component mixture on the magnetic roller sleeve is substantially thoroughly mixed.

18. An arrangement for inking in an electrophotographic printer or copier, comprising:

a magnetic roller having a rotatable magnetic roller sleeve having a circumferential surface to which a two-component mixture comprising toner particles and ferromagnetic carrier particles adhere;

an applicator element having a circumferential surface to be inked with toner particles and past which the two-component mixture adhering to the circumferential surface of the magnetic roller is guided to produce a toner layer on the circumferential surface of the applicator element;

the magnetic roller having a magnetic rotor which comprises magnetic elements and which is arranged inside said magnetic roller sleeve;

the magnetic roller having a magnetic rotor which comprises magnetic elements and which is arranged inside said magnetic roller sleeve;

a rotary axis of the magnetic rotor being an axis parallel to a rotary axis of the magnetic roller sleeve; and the magnetic rotor and the magnetic roller sleeve being moveable relative to one another.

19. A method for inking in an electrophotographic printer or copier, comprising the steps of:

guiding a two-component mixture comprising electrically charged toner particles and ferromagnetic carrier particles adhering to a circumferential surface of a magnetic roller sleeve of a magnetic roller past a circumferential surface of the applicator element to be inked, the magnetic roller comprising a magnetic rotor having several magnetic poles and being arranged inside the magnetic roller sleeve, both the magnetic rotor as well as the magnetic roller sleeve each being rotated about their respective longitudinal axis, and the magnetic rotor and the magnetic roller sleeve being moved relative to one another; and when the two-component mixture is guided past, transferring at least part of the toner particles contained in the two-component mixture onto the circumferential surface of the applicator element to be inked so that a toner layer is produced on the circumferential surface of the applicator element.

* * * * *